United States Patent [19]

Shimonovich

[11] 4,195,595

[45] Apr. 1, 1980

[54] DEVICE FOR POSITIONING LIVESTOCK

[76] Inventor: Shraga Shimonovich, Moshav Banya, Israel

[21] Appl. No.: 941,323

[22] Filed: Sep. 11, 1978

[30] Foreign Application Priority Data

Sep. 12, 1977 [IL] Israel ..... 52922

[51] Int. Cl.[2] ..... A61D 3/00

[52] U.S. Cl. ..... 119/103

[58] Field of Search ..... 119/103, 98

[56] References Cited

U.S. PATENT DOCUMENTS

| | | | |
|---|---|---|---|
| 2,477,213 | 7/1949 | Staggs | 119/98 |
| 2,520,585 | 8/1950 | Walker et al. | 119/103 |
| 2,683,441 | 7/1954 | Beall | 119/103 |
| 2,700,957 | 2/1955 | Keirsey | 119/103 |
| 2,713,326 | 7/1955 | Stephenson | 119/99 |
| 2,733,685 | 2/1956 | La Rue | 119/98 |
| 2,804,046 | 8/1957 | Turner | 119/99 |
| 2,967,510 | 1/1961 | Stoody | 119/103 |
| 3,215,120 | 11/1965 | Geary | 119/98 |
| 3,244,151 | 4/1966 | Gebhart | 119/103 |
| 3,276,433 | 10/1966 | Tougas et al. | 119/103 |
| 3,389,691 | 6/1968 | Poage | 119/103 |
| 3,457,585 | 7/1969 | Edison | 119/103 X |
| 3,590,784 | 7/1971 | Fly | 119/103 |
| 3,633,901 | 1/1971 | Lindquist | 119/103 X |
| 3,752,126 | 8/1973 | Rhoades | 119/103 |
| 3,941,095 | 3/1976 | Hamilton et al. | 119/103 |
| 3,960,113 | 6/1976 | Kratky | 119/99 |
| 3,970,046 | 7/1976 | Boggs | 119/103 |
| 4,031,858 | 6/1977 | Harrington | 119/103 |

*Primary Examiner*—Louis G. Mancene
*Assistant Examiner*—Daniel J. Leach
*Attorney, Agent, or Firm*—Sandler & Greenblum

[57] ABSTRACT

A device for positioning livestock including a frame, apparatus for securing an animal within the frame without requiring operator contact with the animal and apparatus for orienting the frame so as to orient the animal in a desired orientation. The frame may comprise an outer frame which is selectably positionable, and an inner frame, raisably mounted within the outer frame and to which the animal is secured.

11 Claims, 4 Drawing Figures

DEVICE FOR POSITIONING LIVESTOCK

FIELD OF THE INVENTION

The present invention relates to apparatus for selectably positioning livestock and to agricultural machinery generally.

BACKGROUND OF THE INVENTION

In the care of livestock such as cattle there arise a number of occasions wherein it is necessary to immobilize an animal to perform an operation thereon. This may include trimming of the hooves, branding, artificial insemination or various mechanical treatment. Normally, it is desirable that the animal be suspended in a lying position such that access is afforded to its abdomen and hooves. Hand-powered machinery is known for lifting livestock and positioning it in a tilted position. This conventional machinery has the drawback that it requires that a belt be secured under the animal for lifting thereof. Thus the operator must come into close contact with the underside of the animal. This involves a certain element of danger in that the animal may kick the operator and furthermore is strenuous, time consuming and unpleasant.

SUMMARY OF THE INVENTION

The present invention seeks to overcome the disadvantage of prior art apparatus and provides livestock positioning apparatus which does not require the fastening of a belt under the animal.

There is thus provided in accordance with an embodiment of the invention a livestock positioning device including a frame, apparatus for securing an animal within the frame without requiring operator contact with the animal and apparatus for orienting the frame so as to position the animal in a desired orientation.

The frame may comprise an outer frame which is selectably positionable, and an inner frame, raisably mounted within the outer frame and to which the animal is secured.

Power driven apparatus may be provided for orienting the inner and outer frames and for securing the animal to the frame.

In accordance with a preferred embodiment of the invention, the securing apparatus comprises a belt secured to the inner frame and located adjacent one side thereof when in a retracted position; and a power driven member associated with the belt for engaging the side underneath portion of the animal when the animal is located intermediate the belt and the opposite side of the inner frame, thus supporting the animal from underneath and causing the belt to engage the animal from the side, thereby to secure the animal within the inner frame.

The orienting apparatus may include apparatus for first raising the inner frame with respect to the outer frame and then for raising and tilting the frames in a desired sequence to a selectable orientation in which a desired portion of the animal is exposed.

BRIEF DESCRIPTION OF THE DRAWINGS

The invention will be more fully appreciated and understood from the following detailed description taken in conjunction with the drawings in which.

DETAILED DESCRIPTION OF THE INVENTION

Figure 1:
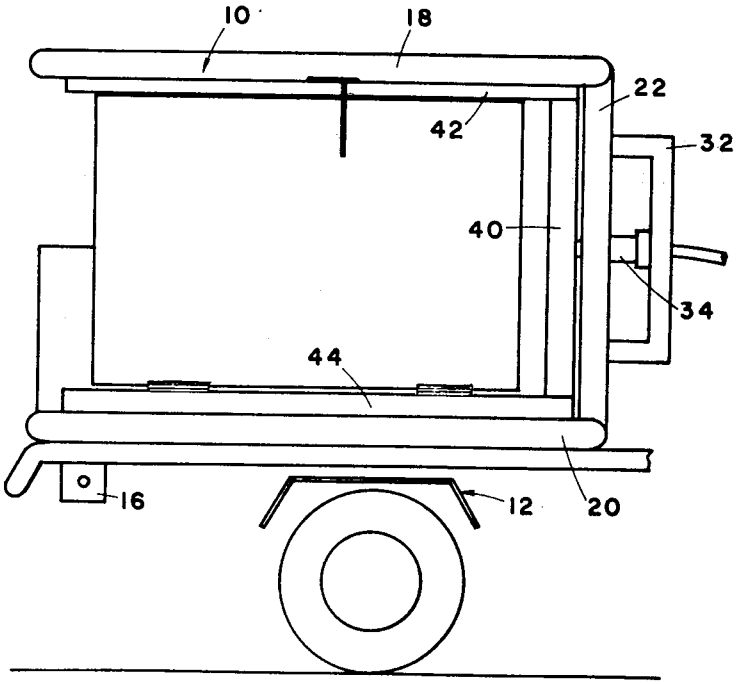
FIG. 1 shows positioning apparatus constructed and operative in accordance with an embodiment of the invention in a storage position on a mounting vehicle.

Referring now to FIGS. 1–4 there is seen in side view illustration positioning apparatus for livestock constructed and operative in accordance with an embodiment of the present invention. A tubular outer frame 10 is disposed on a mounting vehicle, such as a flat bed pick-up truck 12 which is formed to define a cam path 14 with associated support means 16. According to an alternative embodiment of the invention, the positioning apparatus may be mounted on any other suitable vehicle or may be mounted onto a fixed support. Support means 16 may be conventional retractable supports.

Tubular outer frame 10 defines first and second side portions 18 and 20 which are maintained in a desired spaced parallel orientation by top struts 22. The outer frame may conveniently be formed of heavy duty tubular stock, joined together by welding.

First second and third mounting lugs, 24, 26 and 28 are fixed to side portion 20 of outer frame 10 for attachment to power driving apparatus such as a hydraulic piston 30, mounted onto truck 12.

Supported onto outer frame 10 by a mounting structure 32 is a hydraulic cylinder 34, which in turn supports an inner frame 40. Inner frame 40 is typically formed of heavy duty tubular stock by welding or any other joining or forming technique, and defines first and second sides 42 and 44 and front and rear ends. Onto the front of outer frame 10, which is not illustrated in the drawings, there is hinged a conventional livestock neck securing gate and at the rear end there is hinged a gate of sheet metal stock 46. It is intended that an animal should enter the positioning apparatus through the rear gate and leave through the front gate. Animal leg securing grooves 47 are associated with the bottom portion of both gates.

Disposed adjacent the second side 44 of the inner frame 40 there is provided a support plate 48, typically formed of sheet metal. During operation of the apparatus, the animal is urged against support plate 48, and is supported thereby. Adjacent the first side of inner frame 40 there is mounted a hydraulic cylinder 50 having associated therewith a piston 52. Mounted onto piston 52 is an urging member 54. Urging member 54 defines a contact surface of curved, sheet like configuration and is arranged to engage the underneath side portion of an animal as illustrated in the drawings.

It is a particular feature of the invention that both the inner and outer frames are formed without bottom struts which could cause an animal to trip thereon or cause hesitancy of the animal to enter the frame.

A belt member 60 is freely suspended from the top portion of inner frame 40 and extends over the contact surface of the urging member 54 and is secured at its opposite end at a location 45 fixed to side 42 of the inner frame. The belt is arranged such that when the urging member 54 is in an extended position in engagement with an animal, the belt member 60 is drawn tightly about the side of the animal adjacent the first side 42 of the inner frame 40, thereby securing the animal against support plate 48.

It is noted that any of the power apparatus, such as the hydraulic cylinders hereinabove referred to may be alternatively of pneumatic, mechanical, electrical or any other suitable construction.

It will be appreciated that additional securing apparatus such as straps or chains (not shown) are associated with leg securing grooves 47 attached onto the front and rear gates.

Figure 2:
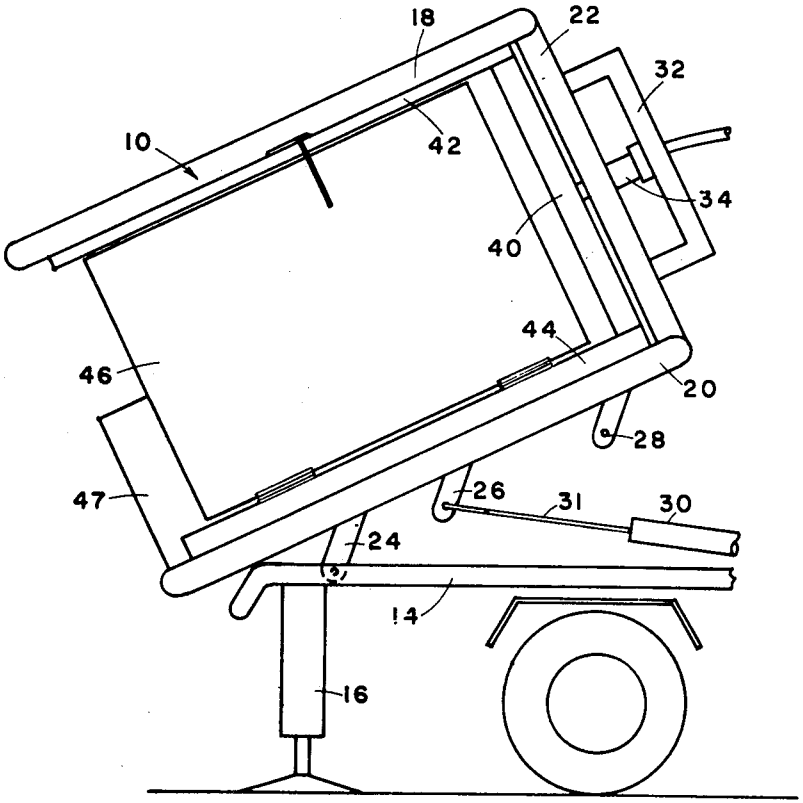
FIG. 2 shows the positioning apparatus of FIG. 1 at a position intermediate storage and stationary positions.
Figure 3:
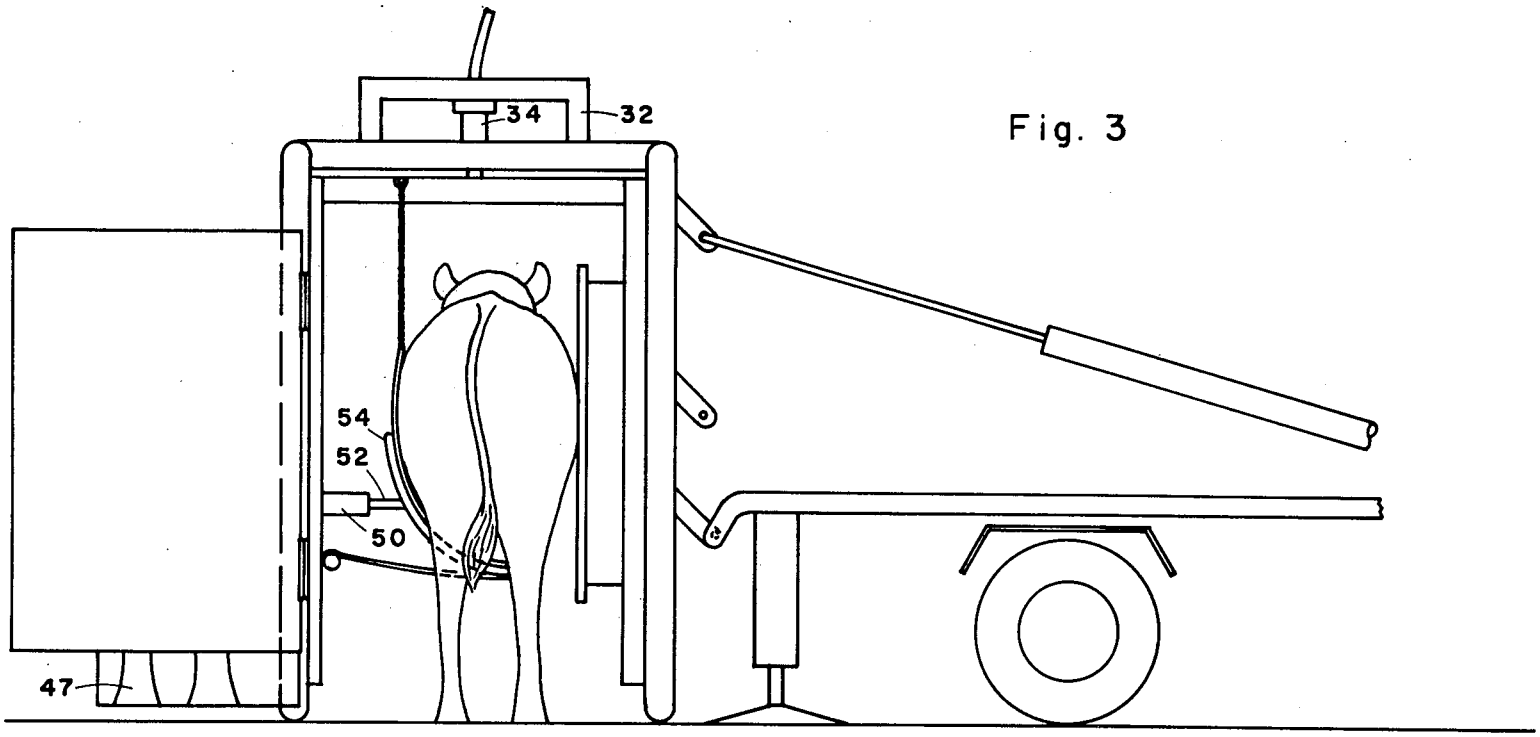
FIG. 3 shows the positioning apparatus of FIG. 1 in a stationary position and in engagement with an animal.

The operation of the apparatus described hereinabove will now briefly by summarized:

It is assumed that the apparatus will be maintained in the storage position illustrated in FIG. 1 during transport from one site to another. Once located as desired, the frame means are lowered into an upstanding stationary position by attachment of driving cylinder 30 to mounting lug 26. Mounting lug 24 meanwhile travels along cam path 14. FIG. 2 illustrates the apparatus in an intermediate position while FIG. 3 illustrates the apparatus in a stationary position with the back gate open and the animal inserted therein.

The apparatus is prepared for entry of an animal by adjusting the inner frame to the animal height and fully retracting urging means 54 and associated belt member 60 so as to define a clear entry path. The animal then enters and is secured at the neck by the securing apparatus incorporated in the front gate. The rear gate is then closed. Hydraulic cylinder 50 is then operated to extend piston 52 and thereby bring urging member 54 into supporting contact with the side underneath portion of the animal, such that the animal is supported between support plate 48 and belt member 60. Cylinder 34 is then operated to raise the inner frame relative to the outer frame thereby to raise the animal's legs off the ground surface.

Figure 4:
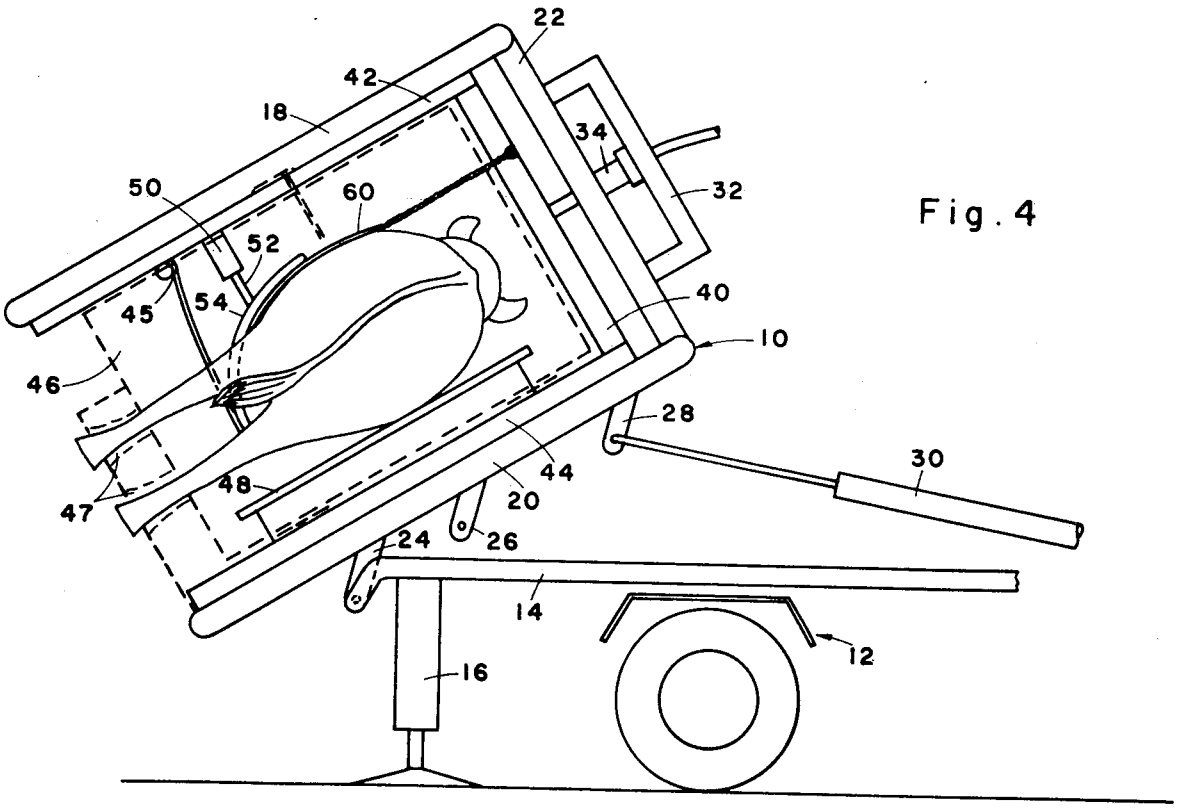
FIG. 4 shows the positioning apparatus of FIG. 1 in a tilted position with the inner frame retracted.

Hydraulic cylinder 30 is then attached to mounting lug 28 and is operated to retract associated piston 31 causing tilting of both the inner and outer frames as illustrated in FIG. 4. The frames may be tilted to any desired angle between the vertical and a horizontal disposition. Once a desired orientation has been reached, the animal's legs are secured to the securing grooves 47 associated with front and rear gates by suitable chains or straps.

Any desired operation, such as cutting of the hooves or medical treatment may then be carried out on the immobilized animal. The orientation of the animal may be varied before and during the operation by operation of cylinders 30 or 34. Upon completion of the operation, the frames are returned to a vertical orientation after release of the animal's legs, and the animal can exit from the apparatus through the front gate.

It is a particular feature of the invention that the securing, lifting and tilting of the animal are all accomplished without requiring the operator to actually contact the animal.

It will be appreciated by persons skilled in the art that although only a single preferred embodiment of the invention has been specifically described and illustrated herein, many other possible embodiments may also occur. The invention is expressly not limited to what has been specifically shown and described herein but rather is defined only by the claims which follow:

I claim:

1. Apparatus for positioning livestock comprising:

frame means;

means for securing an animal in said frame means without requiring operator contact with the animal and including belt means secured to said frame means and located adjacent one side thereof; and means, associated with said belt means, for engaging the side underneath portion of the animal, when the animal is located intermediate the belt means and the opposite side of said frame means, thus supporting the animal from the underneath at one side, and urging the animal against the opposite side of said frame means; and means for orienting said frame means so as to position the animal in a desired orientation.

2. Apparatus according to claim 1 and wherein said frame means comprises:

an outer frame which is selectably positionable; and an inner frame, raisably mounted within said outer frame and to which said animal is secured by said securing means.

3. Apparatus according to claim 1 and wherein said orienting means comprises power driven means.

4. Apparatus according to claim 1 and wherein said frame means is constructed without any lower struts which could interfere with the passage of an animal therethrough.

5. Apparatus according to claim 2 and wherein said means for engaging comprises:

power driven means.

6. Apparatus according to claim 2 and wherein said orienting means comprises means for first raising the inner frame with respect to the outer frame and then raising and tilting the inner frame and the outer frame together in a desired sequence to a selectable orientation in which a selectable portion of the animal is exposed.

7. Apparatus according to claim 1 and wherein said engaging means comprises a contoured plate member.

8. Apparatus according to claim 7 wherein said contoured plate member engages the back surface of said belt means, thus urging said belt means into physical contact with said animal.

9. Apparatus according to claim 1 and also comprising means for securing the feet of an animal secured in said frame means.

10. Apparatus according to claim 9 and wherein said feet securing means comprise grooves attached to said frame means so as to engage the legs of an animal only when it is already inside of said frame means.

11. Apparatus according to claim 9 and also comprising strap means for securing the legs of an animal to said feet securing means.

* * * * *